US005235824A

United States Patent [19]

Huang

[11] Patent Number: 5,235,824

[45] Date of Patent: Aug. 17, 1993

[54] BROOCH HAVING A MOVABLE ORNAMENT

[76] Inventor: Chung S. Huang, No. 1-1, Changma St., Hsiushui Hsiang, Changhua, Hsien, Taiwan

[21] Appl. No.: 946,389

[22] Filed: Sep. 17, 1992

[51] Int. Cl.[5] ..... A44C 1/00

[52] U.S. Cl. ..... 63/20; 63/18; 40/424; 446/337; 185/29

[58] Field of Search ..... 63/20, 2, 18, 19; 446/337, 149, 330; 40/421, 424, 425, 1.5, 1.6, 427; 185/29

[56] References Cited

U.S. PATENT DOCUMENTS

| | | | |
|---|---|---|---|
| 342,677 | 5/1886 | Brandt | 63/1.1 |
| 770,954 | 9/1904 | Boismaare | 63/20 |
| 1,930,164 | 10/1933 | Fletcher | 40/424 |
| 4,215,388 | 7/1980 | Reimann | 40/1.5 |
| 4,698,927 | 10/1987 | Yoshiro | 446/337 |

FOREIGN PATENT DOCUMENTS

| | | | |
|---|---|---|---|
| 10734 | 7/1888 | United Kingdom | 63/18 |

*Primary Examiner*—Peter M. Cuomo
*Assistant Examiner*—Flemming Soether
*Attorney, Agent, or Firm*—Merchant, Gould, Smith, Edell, Welter & Schmidt

[57] ABSTRACT

A brooch including a support fixed in a housing, two flaps pivotally coupled to the support, a rod fixed in the housing, a board fixed on the rod, two rotary members pivotally coupled to the board, and a shaft rotatably engaged on the rod and having two cams engaged with the flaps and the rotary members so as to rotate the flaps and the rotary members.

9 Claims, 2 Drawing Sheets

BROOCH HAVING A MOVABLE ORNAMENT

BACKGROUND OF THE INVENTION

1. Field of the Invention

The present invention relates to a brooch, and more particularly to a brooch having a movable ornament.

2. Description of the Prior Art

A typical brooch includes an ornament fixed to a pin in order to be attached to the cloth of a user, generally, the ornament thereof is fixed and can not move.

The present invention has arisen to mitigate and/or obviate the afore-described disadvantages of the conventional brooches.

SUMMARY OF THE INVENTION

The primary objective of the present invention is to provide a brooch which includes a movable ornament.

In accordance with one aspect of the invention, there is provided a brooch comprising a housing, a support fixed in the housing, at least one member pivotally coupled to the support at a pivot axle, a rod fixed in the housing, a shaft rotatably engaged on the rod and including a cam formed thereon for engagement with the member, and means for rotating the shaft, whereby, the member is rotated about the pivot axle by the cam when the shaft is rotated.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
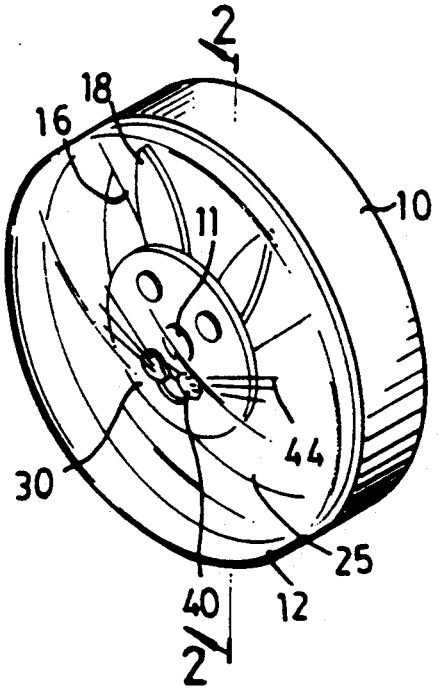
FIG. 1 is a perspective view of a brooch in accordance with the present invention.
Figure 2:
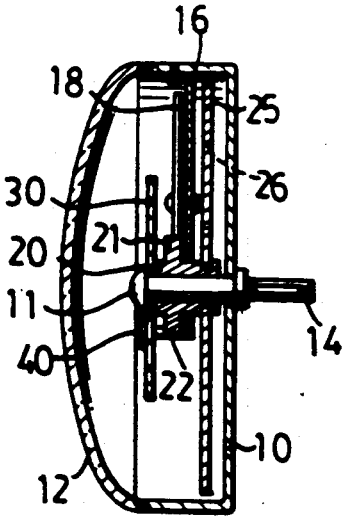
FIG. 2 a cross sectional view taken along lines 2—2 of FIG. 2.
Figure 3:
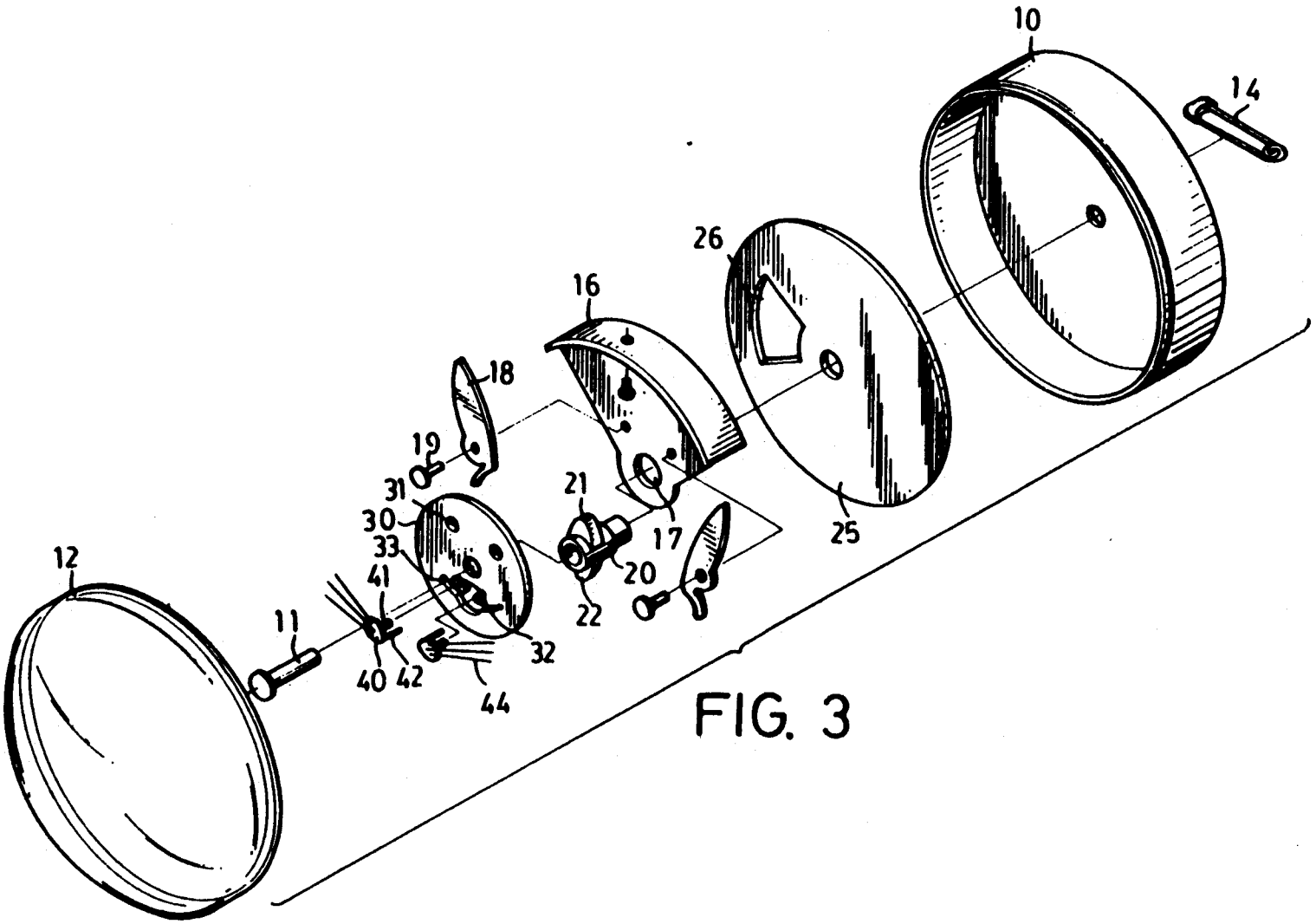
FIG. 3 is an exploded view of the brooch.

Referring to the drawings, and initially to FIGS. 1 to 3, a brooch in accordance with the present invention comprises a housing 10 enclosed by a cap 12 and including a rod 11 fixed to the center portion thereof, and a pin 14 fixed to the housing 10 so as to attach the housing 10 to the cloth and the like of the user. A support 16 in the shape of a sector is fixed in the upper portion of the housing 10 and has an aperture 17 formed in the lower portion thereof and engaged on the rod 11, a pair of flap members 18 each pivotally coupled to the support 16 at a pivot axle 19 in order to simulate the ears of an animal, such as a rabbit, a cat and the like.

A shaft 20 is rotatably engaged on the rod 11 and rotatably engaged in the aperture 17 of the support 16 and includes two cams 21, 22 formed thereon, in which the cam 21 is engaged with the flap members 18, a disc 25 is fixed on the shaft 20 and includes an opening 26 formed therein, the opening 26 is preferably formed in the side portion so that the center of gravity of the disc 25 is eccentric and is not located in the center thereof and so that the disc 25 is apt to be rotated when the user walks or moves.

A board 30 for simulating the face of the animal is fixed on the rod 11 and includes two holes 31 formed in the upper portion for simulating the eyes of the animal, two orifices 32 and two slots 33 are formed in the board 30 so as to simulate the mouth of the animal. The slots 33 are curved and preferably communicated with the orifices 32. A pair of rotary members 40 each includes a first leg 41 rotatably and pivotally engaged in the respective orifice 32 and a second leg 42 slidably engaged in the respective slot 33 and engaged with the cam 22 of the shaft 20, each of the rotary members 40 includes three whiskers 44 fixed thereto so as to simulate the whiskers of the animal.

Figure 4:
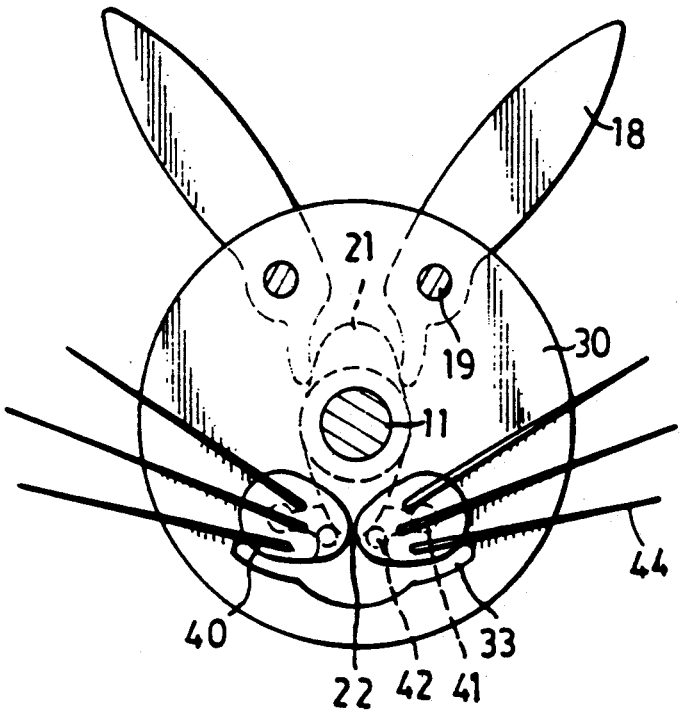
FIG. 4 is a schematic view illustrating the operations of the brooch.

Referring next to FIG. 4, in operation, the shaft 20 and the disc 25 are rotated when the user walks and moves, the flap members 18 and the rotary members 40 are thus actuated by the cams 21, 22 such that the flap members 18 rotate about the respective pivot axles 19 and the rotary members 40 rotate about the respective first legs 41, whereby, the ears and the whiskers of the animal are movable.

Accordingly, the brooch in accordance with the present invention includes an ornament which is movable.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A brooch comprising a housing, a support fixed in said housing, at least one first member pivotally coupled to said support at a pivot axle, a rod fixed in said housing, a shaft rotatably engaged on said rod and including a first cam formed thereon for engagement with said first member, and means for rotating said shaft, said rotating means including a disc fixed on said shaft, said disc including an opening formed therein such that the center of gravity of said disc is off geometric center, whereby, said first member is rotated about said pivot axle by said first cam when said shaft is rotated.

2. A brooch according to claim 1, further comprising a board fixed on said rod and including at least one slot formed therein, said shaft including a second cam formed thereon, at least one second member including a first leg pivotally engaged in said board and a second leg slidably engaged in said slot of said board and engaged with said second cam of said shaft, whereby, said second member is rotated when said shaft rotates.

3. A brooch according to claim 2, wherein at least one whisker is fixed to said second member.

4. A brooch comprising a housing, a rod fixed in said housing, a board fixed on said rod and including at least one slot formed therein, at least one first member including a first leg pivotally engaged in said board and a second leg slidably engaged in said slot of said board, a shaft rotatably engaged on said rod and including a first cam formed thereon for engagement with said first member, and means for rotating said shaft, said rotating means including a disc fixed on said shaft, said disc including an opening formed therein such that the center of gravity of said disc is off geometric center, whereby, said first member is rotated about said pivot axle by said first cam when said shaft is rotated.

5. A brooch according to claim 4, wherein at least one whisker is fixed to said first member.

6. A brooch according to claim 4 further comprising a support fixed in said housing, at least one second member pivotally coupled to said support at a pivot axle, said shaft including a second cam formed thereon and engaged with said second member, whereby, said second member is rotated about said pivot axle when said shaft rotates.

7. A brooch comprising a housing, a pin fixed to said housing for attaching said housing to a user, a support fixed in said housing, two first members pivotally coupled to said support, a rod fixed in said housing, a board fixed on said rod and including two slots formed therein, two second members each including a first leg pivotally engaged in said board and a second leg slidably engaged in said slot of said board, a shaft rotatably engaged on said rod and including two cams formed thereon for engagement with said first members and said second members respectively, and means for rotating said shaft, whereby, said members are rotated by said cams when said shaft is rotated.

8. A brooch according to claim 7, wherein said rotating means includes a disc fixed on said shaft, said disc includes an opening formed therein such that the center of gravity of said disc is off geometric center.

9. A brooch according to claim 7, wherein at least one whisker is fixed to said first member.

* * * * *